US005366011A

United States Patent [19]

Jennings, Jr.

[11] Patent Number: 5,366,011

[45] Date of Patent: Nov. 22, 1994

[54] METHOD FOR PRODUCING HIGH WATER-CUT GAS WITH IN SITU WATER-DISPOSAL

[75] Inventor: Alfred R. Jennings, Jr., Plano, Tex.

[73] Assignee: Mobil Oil Corporation, Fairfax, Va.

[21] Appl. No.: 164,271

[22] Filed: Dec. 9, 1993

[51] Int. Cl.[5] ..... E21B 43/12; E21B 43/38

[52] U.S. Cl. ..... 166/265; 166/306; 166/369; 166/386; 166/387

[58] Field of Search ..... 166/265, 305.1, 305 D, 166/369, 370, 386, 387, 297, 306, 373

[56] References Cited

U.S. PATENT DOCUMENTS

| | | | |
|---|---|---|---|
| 3,167,125 | 1/1965 | Bryan | 166/305.1 X |
| 3,333,638 | 8/1967 | Bishop | 166/306 |
| 3,363,692 | 1/1968 | Bishop | 166/306 |
| 4,296,810 | 10/1981 | Price | 166/265 |
| 4,429,740 | 2/1984 | Malinchak | 166/305.1 X |
| 4,766,957 | 8/1988 | McIntyre | 166/265 |
| 5,296,153 | 3/1994 | Peachey | 166/265 X |

*Primary Examiner*—Stephen J. Novosad
*Attorney, Agent, or Firm*—Alexander J. McKillop; George W. Hager, Jr.; Charles A. Malone

[57] ABSTRACT

A method of producing high water-cut gas via in situ water-disposal. Initially, a well is drilled and cased. The casing is perforated at an upper gas producing interval. Next, a tubing is run down through the casing and its lower end is perforated so as to fluidly communicate with a lower non-productive interval. The tubing is also perforated at a location below the producing interval and a production packer is placed between the casing's lower end and the tubing thereby forming an annulus. A slidable sleeve is positioned in the annulus to selectively open and close perforations on the tube side of the annulus. As gas is produced, water separated from the gas collects in the annulus and falls through perforations in the tubing where it is disposed of in the non-productive interval.

5 Claims, 1 Drawing Sheet

METHOD FOR PRODUCING HIGH WATER-CUT GAS WITH IN SITU WATER-DISPOSAL

FIELD OF THE INVENTION

This invention relates to methods for the removal of entrained water from gaseous hydrocarbons produced from underground formations.

BACKGROUND OF THE INVENTION

Because of environmental concerns, transportation and disposal of waste water weighs heavily on the economics of producing gas wells with high water-cut. First, the majority of oil and gas wells in the Gulf Coast region produce from reservoirs which are commonly classified as water-drive type reservoirs. In a water-drive reservoir, the predominant mechanism which forces the movement of oil or gas in the reservoir toward the wellbore is the advancement of a formation water aquifer. The formation water phase is found beneath the oil or gas phase in a "bottom-water" reservoir or on the outer flanks of the oil or gas column in an "edge-water" reservoir. In either case, water moves into the rock pore spaces which were once filled with hydrocarbonaceous fluids in response to continued production of oil or gas.

Over time, this natural water encroachment leads to the advancement of water into the producing interval, and the well eventually begins to produce quantities of formation water. As the influx of water continues in the reservoir, the percentage of produced water, as compared to total fluid production, increases with time. The ever increasing production rate of formation water is undesirable in both oil and gas wells.

In the case of a gas well, the production of even relatively low quantities of formation water can be detrimental to the productivity of the well. When formation water and natural gas enter the wellbore, each fluid phase begins to travel upward toward an environment of reduced pressure at the surface of the well. As pressure decreases toward the surface, gas contained in the well's tubulars expands, and the velocity of the gas increases accordingly. As a result, the expanding gas acts as a carrying mechanism to continually remove the formation water from the well.

However, as reservoir pressure decreases in response to continued gas production and/or water volumes entering the wellbore continue to increase, the ability of the gas to carry and remove formation water from the well is greatly reduced. As this phenomenon begins to occur, the relatively dense formation water begins to "fall back" into the well. Eventually this water will fill the well's tubing to the point that hydrostatic pressure created by the water column approaches the prevailing reservoir pressure. When this occurs, the productivity of the well is significantly reduced. Increasing water encroachment and/or continued pressure declination results in the eventual cessation of production.

Therefore, what is needed is an effective means of producing water-cut gas i.e., gas with water entrained therein which will permit the water phase to be left behind.

SUMMARY OF THE INVENTION

In the practice of this invention, a casing is placed into a formation so as to penetrate a gas producing interval which interval produces a substantial amount of water along with the gas. The casing is perforated so as to fluidly communicate the casing with the gas producing interval. A tubing is directed from the surface down through the casing through the formation until it penetrates a lower permeable non-producing interval. As the tubing penetrates the casing it forms an annulus with the casing which also projects to the surface. Subsequently, the tubing is perforated at a first location below the gas producing interval thereby fluidly communicating the tubing via the annulus with the gas producing interval. Perforations are also made in the tubing at a second location so as to fluidly communicate the tubing with the lower non-producing interval.

Later, a production packer is placed below perforations in the first location between said casing thereby closing the lower end of the annulus. This causes the perforated first location to fluidly communicate with the gas producing interval along with the non-productive interval. In order to control the entry of water into the tubing's interior, a sliding sleeve is placed in the annulus around the tubing so as to open or close perforations as desired in said first location. When the perforations below the sliding sleeve are open, water produced with the gas into the annulus falls into the lower part of the annulus. This separated water flows from the annulus into interior of the tubing where it exits thereafter into the permeable non-producing lower interval via said perforations. Substantially water free gas is produced up the annulus to the surface.

It is therefore an object of this invention to dispose of water separated from produced gas into a lower portion of a well's tubing that fluidly communicates with a lower non-producing interval.

It is another object of this invention to produce a substantially water free hydrocarbonaceous gas to the surface.

It is a further object of this invention to lower production costs by reducing the amount of water produced to the surface with gaseous hydrocarbons.

BRIEF DESCRIPTION OF THE DRAWING

The drawing is a schematic representation of the preferred embodiment of the invention which details the well tubing, casing, production packer, sliding sleeve, and fluid communication in the upper and lower intervals of the formation.

DESCRIPTION OF THE PREFERRED EMBODIMENTS

Figure 1:
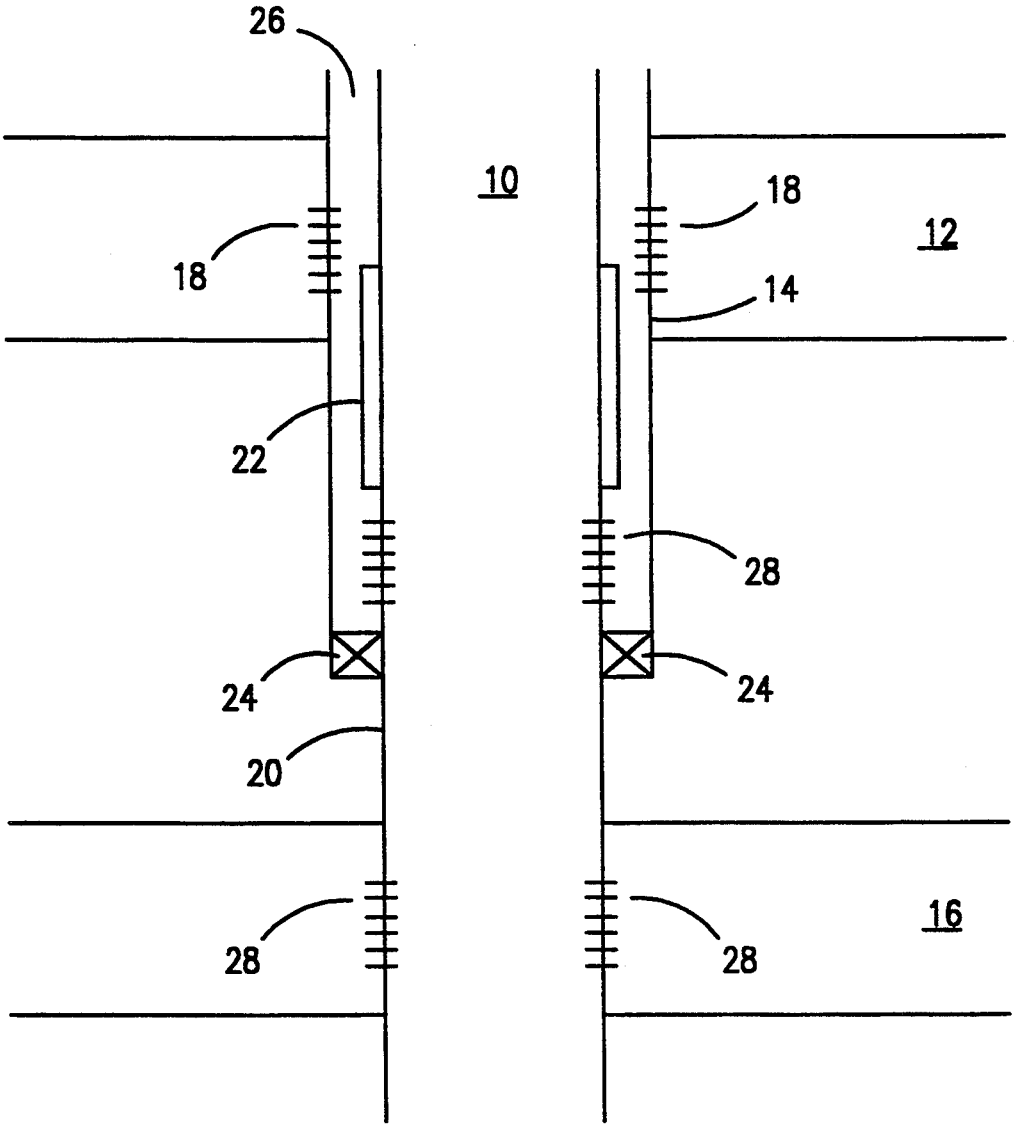

In the practice of this invention, referring to the drawing, a well is drilled through the formation so as to penetrate through an upper productive interval and a lower non-productive interval. After drilling the well, production casing 14 is placed in the well and is subsequently perforated via perforations 18 so as to fluidly communicate with water-cut gas zone or upper producing interval 12. Thereafter, tubing 20 is directed down through the casing whereupon it penetrates into lower permeable non-productive interval 16. Tubing 20 is perforated by perforations 28 so as to fluidly communicate with non-productive interval 16 which is permeable enough to receive water. Subsequently, a production packer 24 is placed at the lower end of production casing 14 thereby forming an annulus with tubing 20. Tubing 20 is next perforated via perforations 28 so as to be in fluid communication with the annulus formed with tubing 20 and production casing 14. Casing/tubing annulus 26 communicates fluidly with the surface so as to remove gases produced from upper producing interval to the surface.

Sliding sleeve 22 is positioned within annulus 26 so as to slide up and down over the perforations 28 within tubing 20. Gaseous hydrocarbons produced from upper producing interval 12 proceed into annulus 26 via perforations 18 and are produced to the surface. Water entrained with the gaseous hydrocarbons also enter the annulus via perforations 18 and falls to the bottom of annulus 26 whereupon it flows therefrom via perforations 28 into wellbore 10. Upon entering wellbore 10, the water is directed into the lower permeable non-productive interval 26 via perforations 28.

Perforations contained within tubing 20 can be smaller than perforations in production casing 14 depending upon the pressures existing in the formation and wellbore 10. In this manner water can flow under pressure from the pressure exerted by gasses emitted to the surface via annulus 26. While water is being produced simultaneously with the production of gaseous hydrocarbon from producing interval 12, gas is also being produced to the surface via annulus When it is desired to stimulate the formation or pressure test the wellbore or do temperature survey work within the well, sliding sleeve 22 is used to close perforations 28 within the annulus. In this manner, gas produced to the surface will carry the entrained water along with it. This water is accumulated and separated accumulated at the surface. When the testing, stimulation, or temperature survey work is completed, the produced water is thereafter directed down the tubing into lower permeable non-productive zone 16 where it is disposed of.

During the course of production, any entrained water carried up the annulus by the gas flow stream will be separated by surface processing facilities. This produced water is accumulated in surface tanks and then periodically injected down the tubing. For this operation the sliding sleeve closes the perforations to allow injection directly into the disposal zone.

The advantage obtained by using sliding sleeve 22 to close off perforations 28 in annulus 26 is that many operations can be performed to maintain the production of gases from producing interval 12. One of the operations that can be performed is pressure testing within wellbore 10. Another operation which can be performed is stimulation of the upper producing interval 12 so as to increase the production of hydrocarbonaceous gasses therefrom. This could involve such operations as acid treating, or steam stimulation to increase the permeability of upper producing interval 12. Also, while slidable sleeve 22 is closing perforations 28 within annulus 26, a temperature survey can be obtained of the formation via wellbore 10 without interfering with the production of gaseous hydrocarbons from upper producing interval 12.

Although the present invention has been described with preferred embodiments, it to be understood that modifications and variations may be resorted to without departing from the spirit and scope of this invention as those skilled in the art will readily understand. Such modifications and variations are considered to be within the purview and scope of the appended claims.

What is claimed:

1. A method for producing high water-cut gas comprising:

a) placing a casing into a formation so as to penetrate a gas producing interval where gas from said interval contains a substantial amount of water therein;

b) perforating the casing so as to fluidly communicate said casing with the gas producing interval;

c) directing a tubing through said casing thereby penetrating a lower non-productive zone and forming an annulus with the casing from the surface for a desired distance below the gas producing interval;

d) perforating said tubing at a first location below the gas producing interval thereby fluidly communicating said tubing with the gas producing interval;

e) perforating said tubing at a second location so as to fluidly communicate the tubing with the non-productive interval;

f) placing a production packer below perforations in the first location and between said casing thereby closing the lower end of the annulus and causing the perforated first location to fluidly communicate with the gas producing interval along with the non-productive interval;

g) positioning a sliding sleeve in the annulus around the tubing so as to open or close perforations as desired in said first location; and h) producing gas from the producing interval to the surface via the perforated casing while water from that interval flows into the non-productive interval via perforation in the second location.

2. The method as recited in claim 1 where the perforations in the first and second locations are smaller than perforations in said casing.

3. The method as recited in claim 1 where the sliding sleeve closes perforations at said first location thereby permitting data about conditions in the wellbore to be obtained without affecting gas production.

4. The method as recited in claim 1 where the sliding sleeve is closed, water is produced with the gas to the surface, accumulated, and periodically dumped down the annulus via opened perforations at the second location opened thereby disposing of the water in the non-productive interval.

5. The method as recited in claim 1 where the sliding sleeve is closed at said first location while pressure testing the wellbore and simultaneously producing gas from the gas producing interval.

* * * * *